US007372420B1

(12) United States Patent
Osterhues et al.

(10) Patent No.: US 7,372,420 B1
(45) Date of Patent: May 13, 2008

(54) ELECTRONICALLY SCANNED ANTENNA WITH SECONDARY PHASE SHIFTERS

(75) Inventors: Gordon D Osterhues, Irvine, CA (US); Alan R Keith, Yorba Linda, CA (US); Neal E Tornberg, Mesa, AZ (US); Percy C Yen, Irvine, CA (US)

(73) Assignee: The Boeing Company, Chicago, IL (US)

( * ) Notice: Subject to any disclaimer, the term of this patent is extended or adjusted under 35 U.S.C. 154(b) by 16 days.

(21) Appl. No.: 11/598,442

(22) Filed: Nov. 13, 2006

(51) Int. Cl.
*H01Q 13/00* (2006.01)

(52) U.S. Cl. ..... 343/776; 343/853

(58) Field of Classification Search ..... 343/754, 343/776, 786, 853; 342/368, 375
See application file for complete search history.

(56) References Cited

U.S. PATENT DOCUMENTS 3,474,447 A * 10/1969 Melancon ..... 342/371
5,276,455 A 1/1994 Fitzsimmons et al.
5,327,147 A * 7/1994 Caille et al. ..... 343/700 MS
5,886,671 A 3/1999 Riemer et al.
6,424,313 B1 7/2002 Navarro et al.
6,580,402 B2 6/2003 Navarro et al.
6,670,930 B2 12/2003 Navarro
6,900,765 B2 5/2005 Navarro et al.
6,989,791 B2 1/2006 Navarro et al.

* cited by examiner

*Primary Examiner*—Tan Ho
(74) *Attorney, Agent, or Firm*—Harness, Dickey & Pierce, P.L.C.

(57) ABSTRACT

An antenna module for an electronically scanned phased array antenna is provided. In various embodiments, the module includes a transmit/receive (T/R) module layer including a plurality of T/R modules. The module additionally includes an external phase shifter layer that includes a plurality of sets of secondary phase shifters. Each secondary phase shifter set is associated with a specific one of the T/R modules. Furthermore, the module includes a horn antenna layer having a plurality of antenna horns. The horn antenna layer is positioned between the T/R module layer and the phase shifter layer such that each horn is aligned between one T/R module and the associated one of the sets of phase shifters.

23 Claims, 3 Drawing Sheets

ELECTRONICALLY SCANNED ANTENNA WITH SECONDARY PHASE SHIFTERS

FIELD

The present teachings relate to electronically scanned antennas and, more particularly, to the reduction of the number of components in electronically scanned antennas.

BACKGROUND

The statements in this section merely provide background information related to the present disclosure and may not constitute prior art.

Both active and passive electronically scanned antennas (ESAs), also commonly referred to as phased array antennas, typically comprise multiple antenna radiating elements, sometimes referred to as radiators, individual element control circuits, a signal distribution network, beam steering control circuitry, a power supply and a mechanical support structure. The total gain, effective isotropic radiated power ("EIRP") (for a transmit antenna) and scanning and side lobe requirements of the antenna are directly related to the diameter of the antenna's aperture, the number of radiators in the antenna aperture, the individual radiator spacing and the performance of the radiators and element electronics. In many applications, thousands of independent radiators and related control circuits are required to achieve a desired antenna performance.

A phased array antenna typically implements independent electronic packages, also referred to as transmit and receive (T/R) modules, for each radiator that are interconnected to a signal distribution circuit board, e.g., a printed wiring board (PWB). To avoid grating lobes, typical ESAs require that antenna radiators with controllable phases be spaced approximately one-half wavelength apart. Additionally, as the antenna operating frequency (and/or beam scan angle) increases, the required spacing between the radiators decreases. Thus, as the antenna operating frequency increases, the spacing between T/R modules also decreases, which increases the number of T/R modules for a fixed aperture diameter.

As the spacing of the radiators and related T/R modules decreases, it becomes increasingly difficult to physically configure the control electronics, i.e., the T/R modules, relative to the tight element spacing. This can affect the performance of the antenna and/or increase its cost, size and complexity. Consequently, the performance of a phased array antenna becomes limited by the need to tightly package and interconnect the antenna radiators and T/R modules associated therewith. For easing the mechanical packaging constraints and reducing the ESA cost, it is sometimes desirable to reduce the number of the T/R modules with a distribution beyond the half wavelength restriction.

SUMMARY

An antenna module for an electronically scanned phased array antenna is provided. In various embodiments, the module includes a transmit/receive (T/R) module layer including a plurality of T/R modules. The module additionally includes an external phase shifter layer that includes a plurality of sets of secondary phase shifters. Each secondary phase shifter set is associated with a specific one of the T/R modules. Furthermore, the module includes a horn antenna layer having a plurality of antenna horns. The horn antenna layer is positioned between the T/R module layer and the phase shifter layer such that each horn is aligned between one T/R module and the associated one of the sets of phase shifters.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
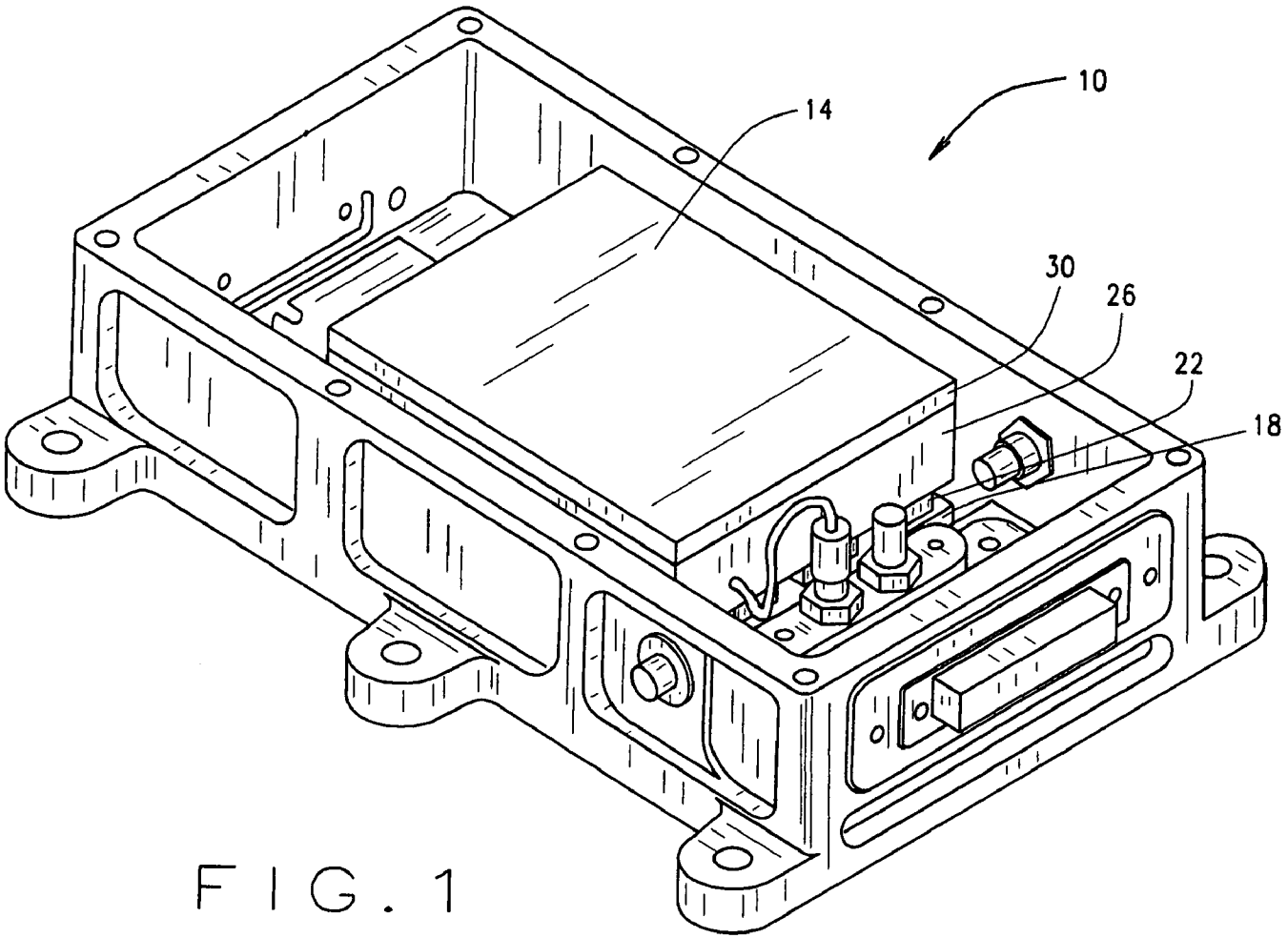
FIG. 1 is an isometric view of an electronically scanned phased array antenna with a top cover removed to illustrate an antenna module included therein, in accordance with various embodiments of the present disclosure.

The following description is merely exemplary in nature and is in no way intended to limit the present teachings, application, or uses. Throughout this specification, like reference numerals will be used to refer to like elements.

Referring to FIG. 1, an electronically scanned phased array antenna (ESA) 10 with a top cover removed to illustrate an antenna module 14 included therein, in accordance with various embodiments of the present disclosure. The antenna module 14 is a layered module including a signal distribution layer 18, a transmit and/or receive (T/R) module layer 22, a horn antenna layer 26 and an external phase shifter layer 30.

Figure 2:
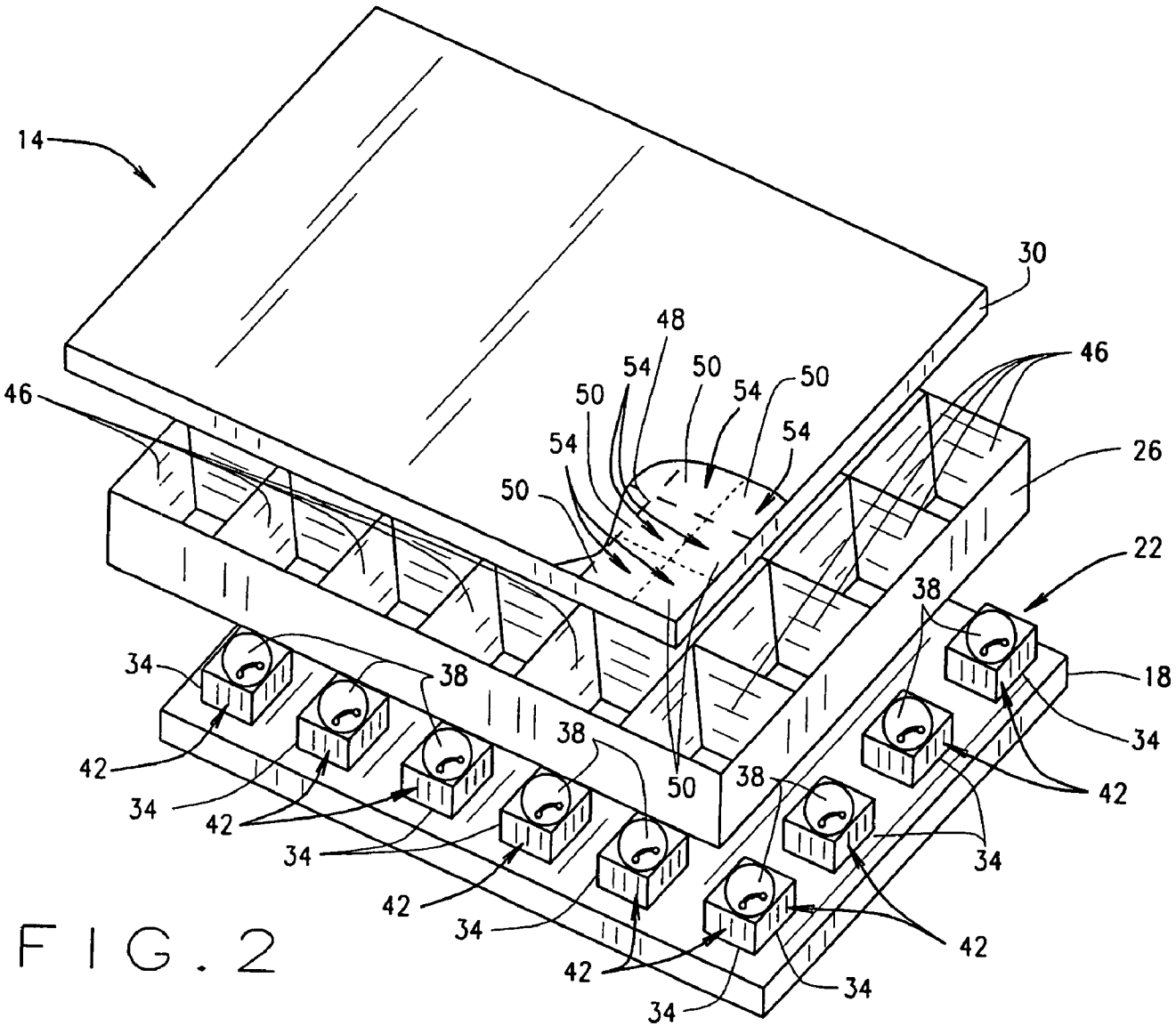
FIG. 2 is an exploded view of the antenna module shown in FIG. 1, in accordance with various embodiments of the present disclosure.

Referring now to FIG. 2, generally, the signal distribution layer 18 is a multi-layer circuit board that distributes radio frequency (RF) energy, i.e., RF signals, to each of a plurality of T/R modules 34 of the T/R module layer 22. Each T/R module 34 is a multi-layer electronics module that includes at least one radiator probe feed element 38 and various beam steering electronic elements. The beam steering elements are not formally illustrated, but are well understood by those skilled in the art. The various layers of each T/R module 34 include the beam steering electronic elements. The beam steering electronic elements can include any electronic element necessary to process the input and/or output RF signals between the radiator probe feeds 38 and the distribution layer 18. For example, the beam steering electronic elements can include monolithic microwave integrated circuits (MMICs), power amplifiers (PAs), low noise amplifiers (LNAs), drivers, attenuators, switches, application specific integrated circuits (ASICs), etc. Particularly, the beam steering elements of each T/R module 34 include a primary phase shifter, generally indicated at 42. As described further below, the primary phase shifter 42 of each T/R module 34 provide the initial beam steering of RF signals emitted by the respective radiator probe feed 38.

It should be understood that although the T/R module layer 22 includes a plurality of T/R modules 34, all T/R modules 34 are substantially identical, thus, for clarity and simplicity, the description herein will often simply reference a single T/R module 34. Additionally, although the T/R modules 34 are illustrated as single, independent modules, in various embodiments the T/R module layer 22 can comprise a single multi-layer circuit board that includes the radiator probe feeds 38 and the beam steering electronic elements associated with each radiator probe feed 38 that comprise the plurality of T/R modules 34. Furthermore, although the antenna module 14 and the T/R modules 34 will generally be described herein in reference to a transmit operational mode, it should be clearly understood that the T/R modules 34, and thus, the antenna module 14, can be operated in a transmit operational mode and/or a receive operational mode. Still further yet, although each T/R module 34 is illustrated having a single radiator probe feed 38, indicative a single polarization T/R module, it should be understood that each T/R module 34 can readily include two radiator probe feeds 38 such that each T/R module 34 will be readily recognized by one skilled in the art as a dual polarization T/R module. Accordingly, each T/R module 34, and thus the antenna module 22, can have either a single polarization or dual polarization functionality and remain within the scope of the present disclosure.

The horn antenna layer 26 includes a plurality of horn antennas 46. More particularly, the horn antenna layer includes one horn antenna 46 for each T/R module 34. The horn antenna layer 26 is a metallic layer having the horn antennas 46 formed therein such that one horn antenna 46 is located above an associated T/R module 34 when the various layers of the antenna module 14 are combined to form the antenna module 14. Therefore, the RF signals emitted from each radiator probe feed 38, as steered by the respective primary phase shifters 42, will be space fed to the external phase shifter layer 30. More particularly, the RF signals emitted from each radiator probe feed 38, as steered by the respective primary phase shifters 42, will be space fed to a respective one of a plurality of quadrants 48, shown in phantom, of the external phase shifter layer 30.

As described further below, the external phase shifter layer 30 is a single multi-layer circuit board. That is, the external phase shifter layer 30 is a single multi-layer circuit board having perimeter dimensions that are equivalent to the size of the ESA 10 aperture. For example, the external phase shifter layer 30 can be fabricated using photolithographic technology. The external phase shifter layer 30 includes various secondary beam steering electronic elements. The secondary beam steering elements are not formally illustrated, but are well understood by those skilled in the art. The secondary beam steering electronic elements can include any electronic element necessary to provide additional, or secondary, beam steering of the initially steered RF signals space fed from the T/R modules 34. For example, the secondary beam steering electronic elements can include monolithic microwave integrated circuits (MMICs), power amplifiers (PAs), low noise amplifiers (LNAs), drivers, attenuators, switches, application specific integrated circuits (ASICs), etc. Particularly, the secondary beam steering elements include a plurality of secondary phase shifters, generally indicated at 54.

Figure 3:
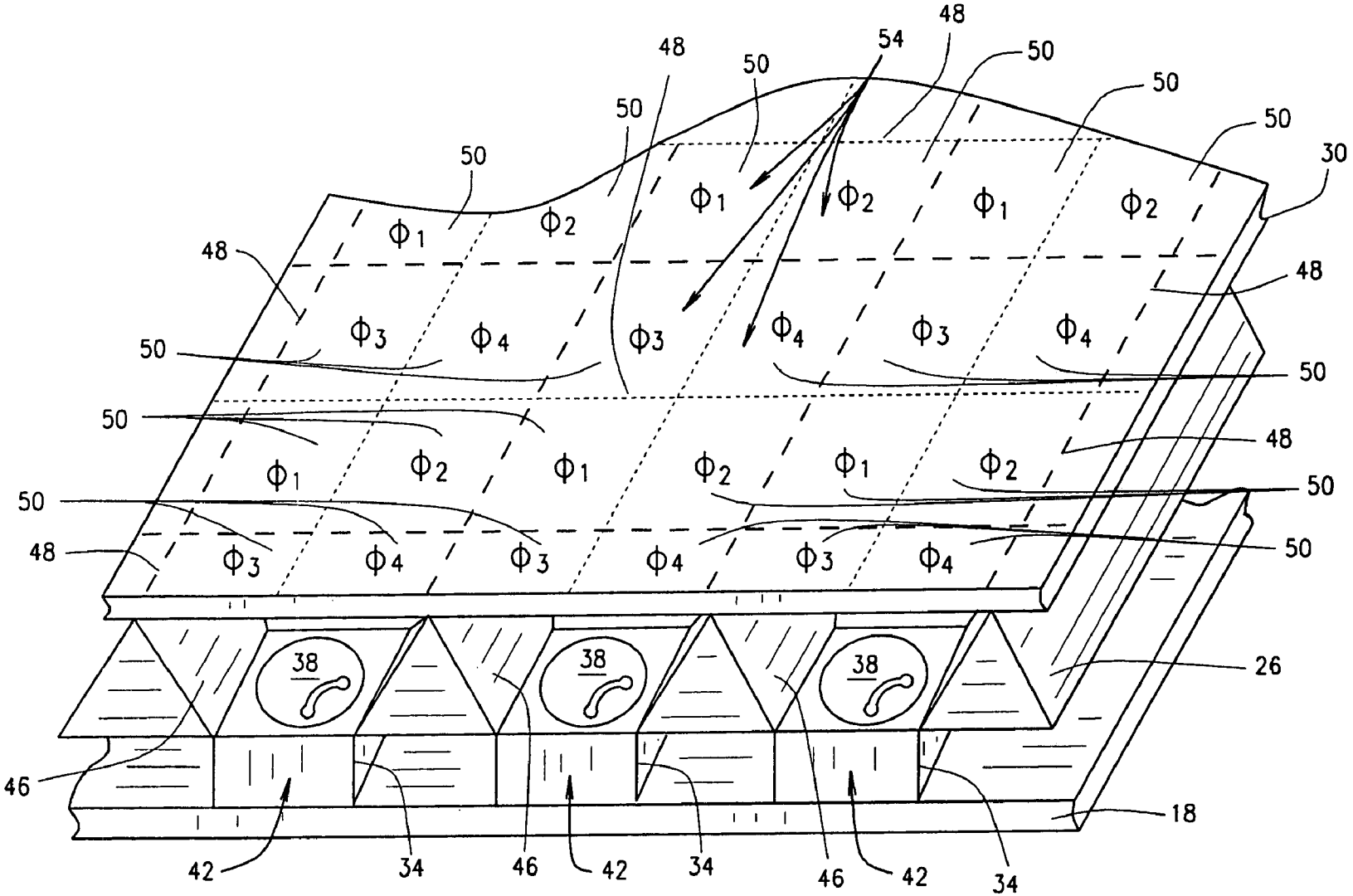
FIG. 3 is a cut-away section of the antenna module shown in FIG. 1, in accordance with various embodiments of the present disclosure.

The secondary beam steering electronic elements are located within the layers of the external phase shifter circuit board, or layer, 30 to form a plurality of secondary beam steering cells 50, shown in phantom and more comprehensively illustrated in FIG. 3. Each quadrant 48 of the external phase shifter layer 30 includes a specific set, or number, of secondary beam steering cells 50. For example, in various embodiments, each quadrant 48 of the external phase shifter layer 30 includes a set of four secondary beam steering cells 50 that are formed in a 2×2 sub-array. In various other embodiments, each quadrant 48 can include other squared sub-arrays, e.g., a 3×3 sub-array or a 4×4 sub-array, of secondary beam steering cells 50. Accordingly, each horn antenna 46 space feeds the RF signals emitted from the respective radiator probe feed 38 of the T/R modules 34 to an associated quadrant 48 of the external phase shifter layer 30. Each secondary beam steering cell 50 of each quadrant 48 provides secondary beam steering to the RF signals emitted from the respective radiator probe feed 38, as initially steered by the primary phase shifters 42 of the respective T/R module 34. More specifically, each beam steering cell 50 includes a secondary phase shifter 54 that provides secondary beam steering to the RF signals emitted from the respective radiator probe feeds 38, as initially steered by the primary phase shifters 42 of the respective T/R modules 34. In various embodiments each beam steering cell 50 has dimensions of one-half wavelength, or slightly less, by one-half wavelength, or slightly less.

Referring now to FIG. 3, as described above, the primary phase shifter 42 of each T/R module 34 provides an initial amount of phase shifting, i.e., beam steering, to the RF signals emitted from the respective radiator probe feeds 38. Each secondary phase shifter 54 provides a second, or subsequent, amount of phase shifting to the respective RF signals that are space fed to the corresponding quadrant 48 of the external phase shifter layer 30. This second, or subsequent, amount of phase shift provided by secondary phase shifters 54 of each beam steering cell 50 is indicated in FIG. 3 by the symbol $\phi$. Thus, in the various embodiments, in which each quadrant includes a 2×2 sub-array of beam steering cells 50, the RF signal emitted and initially steered by the respective T/R module 34 will be divided into four portions by the four secondary beam steering cells 50. Each of the four secondary beam steering cells 50 will then provide secondary, or subsequent, amounts of phase shift to the respective portions of the initially steered RF signal, indicated in FIG. 3 as $\phi_1$, $\phi_2$, $\phi_3$ and $\phi_4$.

In accordance with various embodiments, each beam steering cell 50 of the respective quadrant 48 provides a different amount of secondary beam steering, or phase shifting. Thus, $\phi_1$, $\phi_2$, $\phi_3$ and $\phi_4$ of the respective quadrant 48 each represent a different amount of secondary, or subsequent, beam steering. More particularly, $\phi_1$ of each quadrant 48 of the external phase shifter layer 30 can be controlled by a first beam steering control circuit of the external phase shift circuit board 30 to provide the same amount of subsequent phase shifting to the respective initially steered RF signal of the respective T/R module 34. Similarly, $\phi_2$, $\phi_3$ and $\phi_4$ of each quadrant 48 can be controlled by respective second, third and forth beam steering control circuits of the external phase shift circuit board 30 to provide the same amount of subsequent phase shifting to the respective initially steered RF signal of the respective T/R module 34. For example, if $\phi_1$ is 30°, $\phi_2$ is 35°, $\phi_3$ is 40° and $\phi_4$ is 45°, then the RF signals from each T/R module 34, as initially steered by the respective primary phase shifter 42, will have a first portion subsequently shifted by 30°, a second portion subsequently shifted by 35°, a third portion subsequently shifted by 40° and a fourth portion subsequently shifted by 45°.

In various other embodiments, two or more beam steering cells 50 of each respective quadrant 48 can be controlled by a beam steering control circuit of the external phase shift circuit board 30 to provide the same amount of secondary beam steering, or phase shifting. Thus, $\phi_1$ and $\phi_2$, of a particular quadrant 48, can be controlled by a first beam steering control circuit of the external phase shift circuit board 30 to provide a first amount of secondary beam steering. And, $\phi_3$ and $\phi_4$ of the that quadrant 48 can be controlled by a second beam steering control circuit of the external phase shift circuit board 30 to provide a second amount of secondary beam steering. In yet various other embodiments, each beam steering cell 50 of the entire external phase shift circuit board 30 can be individually controlled to provide a secondary amount of phase shift particular to the respective beam steering cell 50.

The secondary phase shifting provided by beam steering cells 50 of the single multi-layer external phase shift circuit board 30 introduce additional, i.e., secondary, phase shifting to modify the initial phase shifting provided by the primary phase shifters 42. The modification of the initial phase shifting by the beam steering cells 50 suppresses, i.e., substantially reduces or eliminates, grating lobes. Accordingly, the T/R modules 34 can be spaced apart at distances greater then one-half wavelength. The secondary beam steering provided by the beam steering cells 50 substantially reduces, and preferably eliminates, grating lobes that would normally occur due to the greater than one-half wavelength spacing. It should be understood that although the beam steering provided by the primary phase shifters 42 is referred to herein as the initial phase shifting and the beam steering provided by the beam steering cells is referred to herein as the secondary phase shifting, it should not be inferred that the primary phase shifters 42 necessarily provide a greater amount of phase shift than the secondary phase shifters 54.

In various embodiments, the primary phase shifters 42 can provide the majority of beam steering of the RF signals and the secondary phase shifters 54 augment the initial beam steering to suppress the grating lobes and do not provide significant beam steering. That is, the primary phase shifters 42 can provide coarse phase shifting while the secondary phase shifters 54 provide fine phase shifting to reduce or eliminate grating lobes. In such embodiments, the primary phase shifters 42 can have a phase shift range of approximately 0° to 360°, while the secondary phase shifters can have a phase shift range of approximately 0° to 90°.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. An antenna module for an electronically scanned phased array antenna, said module comprising:

a transmit/receive (T/R) module layer including a plurality of T/R modules;

an external phase shifter layer including a plurality of sets of secondary phase shifters, each set associated with a specific one of the T/R modules;

a horn antenna layer including a plurality of antenna horns, the horn antenna layer positioned between the T/R module layer and the phase shifter layer such that each horn is aligned between one T/R module and the associated one of the sets of phase shifters.

2. The module of claim 1, wherein each T/R module is mounted to a signal distribution board.

3. The module of claim 1, wherein each T/R module includes at least one radiator probe feed for at least one of emitting and receiving radio frequency (RF) signals.

4. The module of claim 3, wherein each T/R module includes a primary phase shifter for providing initial steering of RF signals emitted by the radiator probe feed of the respective T/R module.

5. The module of claim 4, wherein each emitted RF signal is space fed to the associated secondary phase shifter set via the horn antenna layer.

6. The module of claim 4, wherein each set of secondary phase shifters includes a plurality of secondary phase shifters for providing secondary steering that modifies the respective RF signal initially steered by the primary phase shifter.

7. The module of claim 6, wherein each secondary phase shifter within the respective set of secondary phase shifters modifies the respective RF signal differently than the other secondary phase shifters within the respective set of secondary phase shifters.

8. The module of claim 1, wherein the external phase shifter layer comprises a single multi-layer circuit board comprising the plurality of secondary phase shifter sets.

9. The module of claim 1, wherein each T/R module comprises two radiator probe feeds such that the antenna module is dual polarized.

10. An electronically scanned phased array antenna comprising:

a housing; and an antenna module mounted within the housing, the antenna module including:

a transmit/receive (T/R) module layer including a plurality of T/R modules;

an external phase shifter layer including a plurality of sets of secondary phase shifters, each set associated with a specific one of the T/R modules;

a horn antenna layer including a plurality of antenna horns, the horn antenna layer positioned between the T/R module layer and the phase shifter layer such that each horn is aligned between one T/R module and the associated one of the sets of phase shifters.

11. The antenna of claim 10, wherein each T/R module is mounted to a signal distribution board.

12. The antenna of claim 10 wherein each T/R module includes at least one radiator probe feed for at least one of emitting and receiving radio frequency (RF) signals.

13. The antenna of claim 12, wherein each T/R module includes a primary phase shifter for providing initial steering of RF signals emitted by the radiator probe feed of the respective T/R module.

14. The antenna of claim 13, wherein each emitted RF signal is space fed to the associated secondary phase shifter set via the horn antenna layer.

15. The antenna of claim 13, wherein each set of secondary phase shifters includes a plurality of secondary phase shifters for providing secondary steering that modifies the respective RF signal initially steered by the primary phase shifter.

16. The antenna of claim 15, wherein each secondary phase shifter within the respective set of secondary phase shifters modifies the respective RF signal differently than the other secondary phase shifters within the respective set of secondary phase shifters.

17. The antenna of claim 10, wherein the external phase shifter layer comprises a single multi-layer circuit board comprising the plurality of secondary phase shifter sets.

18. The antenna of claim 10, wherein each T/R module comprises two radiator probe feeds such that the antenna module is dual polarized.

19. An antenna module for an electronically scanned phased array antenna, said module comprising:

a transmit/receive (T/R) module layer including a plurality of T/R modules, each T/R module including:

at least one radiator probe feed for at least one of emitting and receiving radio frequency (RF) signals; and a primary phase shifter for providing initial steering of RF signals emitted by the radiator probe feed of the respective T/R module;

an external phase shifter layer including a plurality of sets of secondary phase shifters, each set associated with a specific one of the T/R modules for providing secondary steering that modifies the RF signal steered by the primary phase shifter of the associated T/R module;

a horn antenna layer including a plurality of antenna horns, the horn antenna layer positioned between the T/R module layer and the phase shifter layer such that each horn is aligned between one T/R module and the associated one of the sets of phase shifters so that each emitted RF signal is space fed to the associated secondary phase shifter set via the horn antenna layer.

20. The module of claim 19, wherein each set of secondary phase shifters includes a plurality of secondary phase shifters for providing the secondary steering that modifies the respective RF signal steered by the primary phase shifter.

21. The module of claim 20, wherein each secondary phase shifter within the respective set of secondary phase shifters modifies the respective RF signal differently than the other secondary phase shifters within the respective set of secondary phase shifters.

22. The module of claim 19, wherein the external phase shifter layer comprises a single multi-layer circuit board comprising the plurality of secondary phase shifter sets.

23. The module of claim 19, wherein each T/R module comprises two radiator probe feeds such that the antenna module is dual polarized.

* * * * *